US005517940A

United States Patent [19]

Beyer

[11] Patent Number: 5,517,940

[45] Date of Patent: May 21, 1996

[54] VARIABLE WIDTH MULTI-HULLED BOAT WITH TELESCOPING MAST

[76] Inventor: Jay R. Beyer, 1021 Gapter Rd., Boulder, Colo. 80303-2924

[21] Appl. No.: 437,033

[22] Filed: May 8, 1995

[51] Int. Cl.[6] ..... B63B 7/00

[52] U.S. Cl. ..... 114/354; 114/39.1; 114/61; 114/90; 114/77 R

[58] Field of Search ..... 114/61, 77 R, 114/77 A, 102, 103, 104, 90, 39.1

[56] References Cited

U.S. PATENT DOCUMENTS

| | | | |
|---|---|---|---|
| 3,395,664 | 8/1968 | Greenberg et al. | 114/39.1 |
| 3,925,837 | 12/1975 | Miller | 114/61 |
| 3,937,166 | 2/1976 | Lindsay . | |
| 3,978,536 | 9/1976 | Howe . | |
| 4,223,621 | 9/1980 | Berger . | |
| 4,230,060 | 10/1980 | McCoy | 114/103 |
| 4,337,543 | 7/1982 | Van Ulzen . | |
| 4,457,248 | 7/1984 | Thurston . | |
| 4,655,154 | 4/1987 | Leonard . | |
| 4,718,370 | 1/1988 | Portell-Vila . | |
| 4,757,779 | 7/1988 | Graveline . | |
| 4,796,554 | 1/1989 | Laib . | |
| 4,829,926 | 5/1989 | Voelkel . | |
| 5,263,429 | 11/1993 | Brinkmann | 114/103 |

FOREIGN PATENT DOCUMENTS

| | | | |
|---|---|---|---|
| 3228579 | 2/1984 | Germany | 114/61 |

*Primary Examiner*—Jesus D. Sotelo

[57] ABSTRACT

A variable width boat includes a plurality of hulls and a width varying arrangement connected to and between the hulls for selectively moving the hulls between a closed, folded position and an extended, unfolded position in which the hulls are laterally spaced apart from one another. The variable width arrangement maintains the hulls in an upright, longitudinally fixed, substantially parallel relationship as the hulls are moved laterally between the closed and extended positions. In another aspect of the invention, a mast for use in a sailboat includes a mast assembly having a plurality of telescoping mast sections. The mast sections are arranged to collapse telescopically to permit the height of the mast to be reduced. The mast also includes a mast raising arrangement for raising and lowering the mast. In one preferred embodiment, the mast further includes a plurality of profiled sail supporting ribs each having a peripheral edge. The sail supporting ribs are connected to the upper end of an associated one of the mast sections and a covering is connected to the peripheral edge of the plurality of sail supporting ribs such that the sail supporting ribs and covering cooperate to form a wing shaped sail surface when the mast is in the raised position and the covering folds accordion style when the mast is in the lowered position.

24 Claims, 9 Drawing Sheets

VARIABLE WIDTH MULTI-HULLED BOAT WITH TELESCOPING MAST

BACKGROUND OF THE INVENTION

The present invention relates to multi-hulled boats, and more specifically to multi-hulled boats having a variable width and folding cabin to facilitate trailering. In another aspect of the invention, a telescoping mast is provided for a sail driven version of the boat.

Multi-hulled boats have many characteristics that make them desirable for recreational boaters. As a general rule, they tend to have a wide beam which provides significantly more deck and cabin space than similar length traditional monohull boats. The typically long and slender hulls of a multi-hulled boat are more easily driven through the water making multi-hulled boats generally faster and more economical to operate. In sailing applications, the wide beam typically eliminates the need for a heavy keel, again improving speed and economy of operation. The wide beam also provides a very stable platform. Heel angles are substantially reduced making sailing much more comfortable for recreational sailors. However, in many cases, the extended beam gives the multi-hulled vessel the disadvantage of being too wide for convenient trailering and transportation by road.

To overcome this problem, especially in trimarans, many designs have been proposed that contemplate folding or otherwise decoupling the floats from the central hall in order to permit the vessel to reduce its width for trailering. For Example, U.S. Pat. No. 3,937,166 describes a trimaran having a pair of outrigger style retractable floats that are arranged so that the float connection assembly can be pivoted with respect to the main hull. While the described pivoting arrangement has been commercially successful, the nature of the pivot structure necessarily limits the size of the structures that can be supported on the outer floats. For example, in the described embodiment, the cabin is limited to the central hull while the floats are effectively limited to serve as storage compartments. Similar drawbacks are encountered in U.S. Pat. Nos. 4,457,248 and 4,223,621, which disclose trimaran vessels having foldable outrigger style floats.

In contrast, one of the advantages of catamarans and other non-trailerable trimarans is their potential for significantly increasing the available cabin space by constructing a cabin that extends at least partially between the hulls. Specifically, in many recreational cruising multi-hull boats, the cabins are designed to extend over the space between the hulls and the hulls are constructed to be large enough to provide useful cabin space. However, to date, it has proved to be quite difficult to provide a truly trailerable multi-hulled boat that has a large cabin which extends between the hulls. The present invention discloses an easily trailerable multi-hulled boat with hulls large enough to provide usable cabin space and an enclosed cabin extending between the hulls of the boat.

It is noted that there have been several variable width pontoon boats that have been designed with trailering in mind. However, the designs are generally not suitable for sailboats or vessels having cabins. For example, U.S. Pat. No. 3,978,536 discloses a pontoon boat that can be folded for land transport. However, the design contemplates securing a trailer or camper to the pontoon boat for cabin space. The camper must then be detached prior to trailering the pontoon boat. Such detachable campers are wholly unsuited for sailing vessels, along with being time consuming during launching and trailering of the vessel. U.S. Pat. Nos. 4,829,926 and 4,337,543 also discloses boats that can be folded for land transport, however, they do not provide for any enclosed cabin space.

In order to trailer a sailing vessel, it is imperative that the mast and sail be broken down in order to meet vehicle height restrictions. This is most often done by detaching the mast from its base and lashing it to the vessel. However, this process, along with the remounting of the mast at launching, is a time consuming and labor intensive task. Often, rigging must be detached to break down the mast and readjusted each time the mast is remounted. This makes removal of the mast undesirable.

Alternatively, some masts have been pivotally mounted so that the mast may be lowered for trailering. For example, U.S. Pat. No. 4,655,154 and U.S. Pat. No. 4,718,370 describe collapsible mast assemblies that are arranged so that the mast can be pivoted with respect to the boat and lowered into a horizontal position. Although the described arrangements assist in the lowering of the mast, the sails must still be lowered and dismounted along with dismounting at least some of the rigging. This again is labor intensive and time consuming both when launching and trailering the vessel. The present invention includes a telescoping mast and sail system which eliminates the need to dismount the sails, rigging, and mast, significantly reducing the time and labor required for launching and trailering the boat.

SUMMARY OF THE INVENTION

As will be described in more detail hereinafter, a first aspect of the present invention discloses a variable width multi-hulled boat and a second aspect discloses a telescoping mast for a sailboat. The variable width boat includes a plurality of hulls and a width varying arrangement connected to and between the hulls for selectively moving the hulls between a closed, folded position and an extended, unfolded position in which the hulls are laterally spaced apart from one another. The variable width arrangement maintains the hulls in an upright, longitudinally fixed, substantially parallel relationship as the hulls are moved laterally between the closed and extended positions.

In one preferred embodiment of the present invention, a laterally collapsible beam operatively connects the hulls, and a plurality of structural panels are pivotally connected to and between the hulls. The structural panels, in coordination with the collapsible beams, maintain the hulls in an upright, substantially parallel, longitudinally fixed relationship while permitting the width of the boat to be reduced. The boat also includes a folding arrangement for selectively moving the hulls between a folded position and an extended, unfolded position. The folding arrangement folds the structural panels in coordination with collapsing the collapsible beam.

In a specific version of this embodiment of the present invention, the structural panels include laterally adjacent deck and roof panels pivotally connected to and between the hulls along axes substantially parallel to the longitudinal axes of the hulls. The deck and roof panels cooperate to form a usable cabin area and deck area between the hulls when the boat is in the extended position. Furthermore, the collapsible beam includes a plurality of beam panels at least some of which are pivotally connected to the hulls along substantially vertical axes such that the beam panels fold in coordination with the structural panels. The collapsible beam also includes a telescoping beam arranged such that the telescoping beam nests into openings in the hulls when the boat is moved into the folded position.

In one example of this specific version, the boat includes four deck and four roof panels and two collapsible beams with each of the collapsible beams including four beam panels. The boat further includes a longitudinally extending central frame fixed to and between midpoints of the telescoping beams of the collapsible beams and pivotally connected to and between at least some of the deck and roof panels along axes substantially parallel to the longitudinal axes of the hulls. The central frame is also pivotally connected to and between at least some of the beam panels along substantially vertical axes. The boat further includes a port and a starboard frame pivotally connected to and between at least some of the deck and roof panels along axes substantially parallel to the longitudinal axes of the hulls. The port and starboard frames cooperating with the central frame to coordinate the movement of the deck, roof, and beam panels throughout the folding and unfolding operation.

In another feature of the present invention, the boat includes a plurality of folding seating panels pivotally connected to the hulls and the additional frames along axes substantially parallel to the longitudinal axes of the hulls. The seating panels are arranged to form seats when the boat is in the extended position and fold in coordination with the deck and roof panels during the folding and unfolding operation.

In another feature of the present invention, the boat includes a plurality of windshield panels pivotally connected to the roof panels and a plurality of door panels pivotally connected to the hulls. The windshield panels and door panels cooperating with the deck and roof panels to allow the cabin area to be enclosed when the boat is in the extended position.

In another feature of the present invention, the boat includes a plurality of rudders, each rudder being associated with one of the hulls. The boat further includes a steering arrangement for facilitating the steering of the boat. The steering arrangement operatively connects the plurality of rudders, and the steering arrangement is arranged to permit steering control of the rudders throughout the folding and unfolding operations.

In one preferred embodiment of the folding arrangement of the present invention, the folding arrangement includes (i) a plurality of pulleys mounted to specific locations of the boat, (ii) a cable routed through the plurality of pulleys, and (iii) a bi-directional winch for moving the cable such that when the cable is moved in a first direction the hulls are drawn into the folded position and when the cable is moved in a second, opposite direction the hulls are moved into the extended position.

In another aspect of the invention, a mast assembly for use in a sailboat is disclosed. The mast assembly includes a mast made up of a plurality of telescoping mast sections each having an upper and a lower end. The mast sections are arranged to collapse telescopically to permit the height of the mast to be reduced. The mast assembly also includes a mast raising arrangement for selectively moving the mast between a raised, extended position and a lowered, collapsed position.

In one preferred embodiment of the present invention, the mast is a rotatable mast and the mast assembly further includes a mast steering arrangement for facilitating rotational control of the mast. The mast steering arrangement includes a sail steering wheel control and a cable system that operatively connects the steering wheel control to the rotatable mast. The steering arrangement is arranged to permit full rotational control of the rotatable mast through a continuous 360 degree rotation of the mast.

In another embodiment of the present invention, the mast assembly includes a plurality of profiled sail supporting ribs each having a peripheral edge. Each of the sail supporting ribs is connected to the upper end of an associated mast section. The mast assembly further includes a covering connected to the peripheral edge of the plurality of sail supporting ribs such that the sail supporting ribs and the covering cooperate to form a wing shaped sail surface when the mast assembly is in the raised position and such that the covering folds accordion style when the mast assembly is moved into the lowered position.

In another feature of the immediately above described embodiment, the mast assembly includes internal running rigging. The internal running rigging is attached to specific locations on the peripheral edges of the sail supporting ribs and specific locations on the mast sections to provide structural support to the mast assembly when the mast assembly is in the raised position. The running rigging is also arranged to collapse in coordination with the covering when the mast assembly is moved to the lowered position.

In another embodiment of the present invention, the mast raising arrangement includes (i) a plurality of pulleys mounted at the upper and lower ends of each of the mast sections, (ii) a cable routed through the pulleys, and (iii) a bi-directional winch for raising and lowering the height of the mast assembly. The winch is operatively connected to the cable such that when the winch moves the cable in a first direction, the mast assembly extends telescopically, and when the winch moves the cable in a second, opposite direction, the mast assembly collapses telescopically.

BRIEF DESCRIPTION OF THE DRAWINGS

The features of the present invention may best be understood by reference to the following description of the presently preferred embodiments together with the accompanying drawings in which.

DETAILED DESCRIPTION

Figure 1:
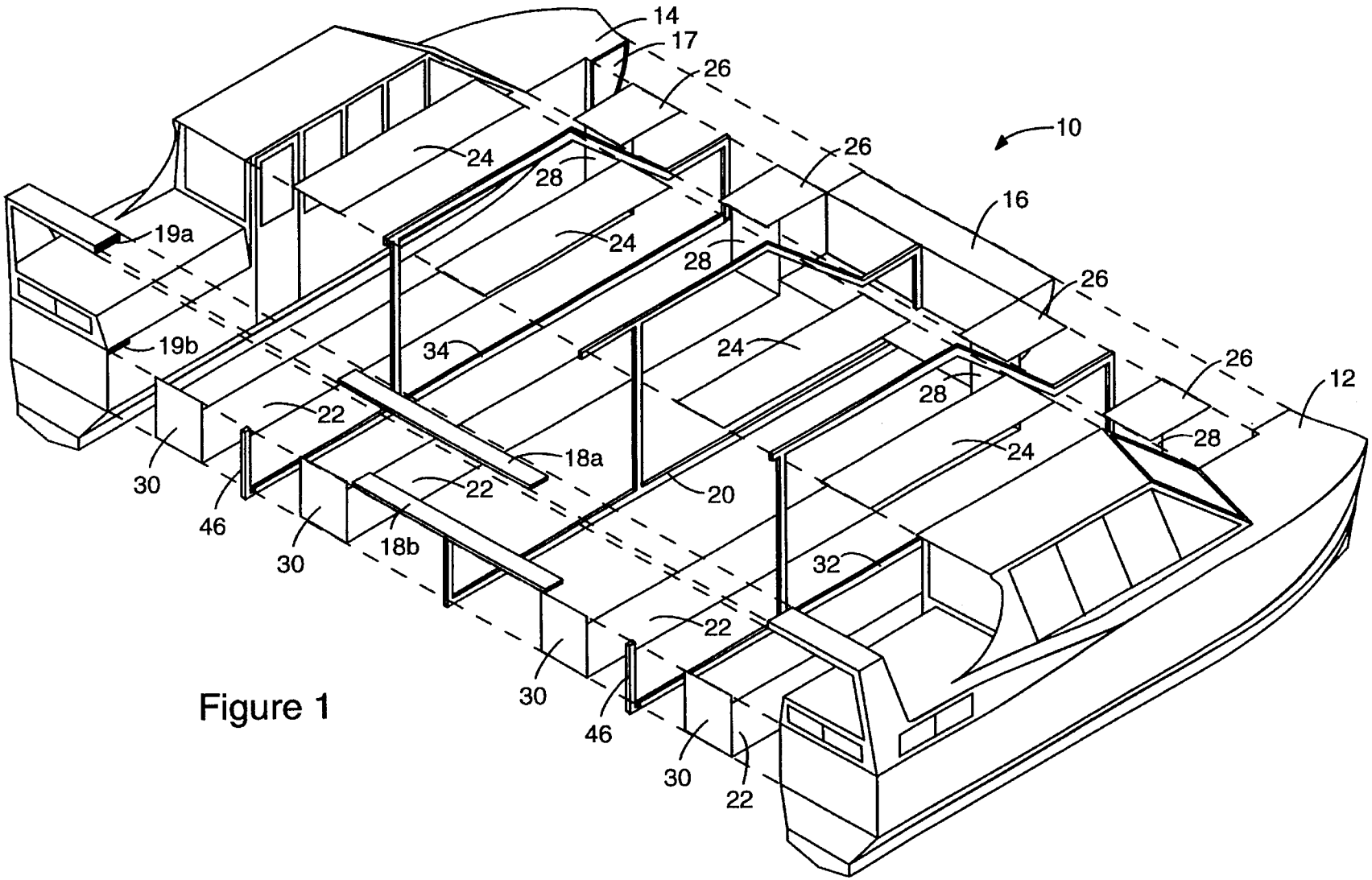
FIG. 1 is a diagrammatic exploded orthographic view of a catamaran version of a variable width sailboat in accordance with a preferred embodiment of the present invention.

As illustrated in FIGS. 1–8, one preferred embodiment of the present invention takes the form of a trailerable catamaran style sailing vessel having a width varying arrangement for varying the width of the vessel and a pair of telescoping masts for supporting a pair of collapsible wing sails. Referring initially to FIGS. 1–4, a catamaran having a width varying arrangement in accordance with a preferred embodiment of the present invention and generally designated by reference numeral 10 will be described. As shown best in FIG. 1, catamaran 10 includes a starboard hull 12, a port hull 14, and a width varying arrangement or deck folding arrangement interconnecting the hulls. In this embodiment, this deck folding arrangement includes a forward telescoping beam 16 which nests into openings 17 in the hulls, a pair of aft telescoping beams 18*a* and 18*b* which nest into openings 19*a* and 19*b* in the hulls, a central frame 20, a plurality of cabin deck panels 22, a plurality of cabin roof panels 24, a plurality of foredeck panels 26, a plurality of forward beam panels 28, a plurality of aft beam panels 30, a starboard frame 32, and a port frame 34.

The hulls are movably coupled together by a forward and an aft collapsible beam assembly which allow the hulls to be laterally moved relative to one another between an unfolded, extended position and a folded, closed position. The forward collapsible beam assembly includes forward telescoping beam 16 and forward beam panels 28 (visible only in FIG. 1) and the aft collapsible beam assembly includes aft telescoping beams 18*a* and 18*b* and aft beam panels 30. Hulls 12 and 14 are also movably coupled together by cabin deck panels 22, cabin roof panels 24, foredeck panels 26, forward beam panels 28, and aft beam panels 30 which are all pivotally connected to and between the hulls, central frame 20, starboard frame 32, and port frame 34.

As will be described in more detail hereinafter, the above described panels, frames, and collapsible beams cooperate to permit the width of the boat to be reduced by folding the panels accordion style while maintaining the hulls in an upright, longitudinally fixed, parallel relationship. This provides stability that allows the folding process to take place while the vessel is still on the water under light sail or motoring. Also, by maintaining the hulls in an upright, longitudinally fixed, parallel relationship throughout the folding and unfolding operation, passengers may comfortably remain on board in or on the hulls. Therefore, the folding and unfolding process can take place completely after launching and prior to trailering by simply clearing the folding deck and cabin area of passengers and provisions and operating the deck folding arrangements in the appropriate direction. This dramatically reduces the time and labor required to launch and trailer the boat compared with other variable width boats while also providing a much larger cabin and deck area compared to other boats of similar length.

Figure 2:
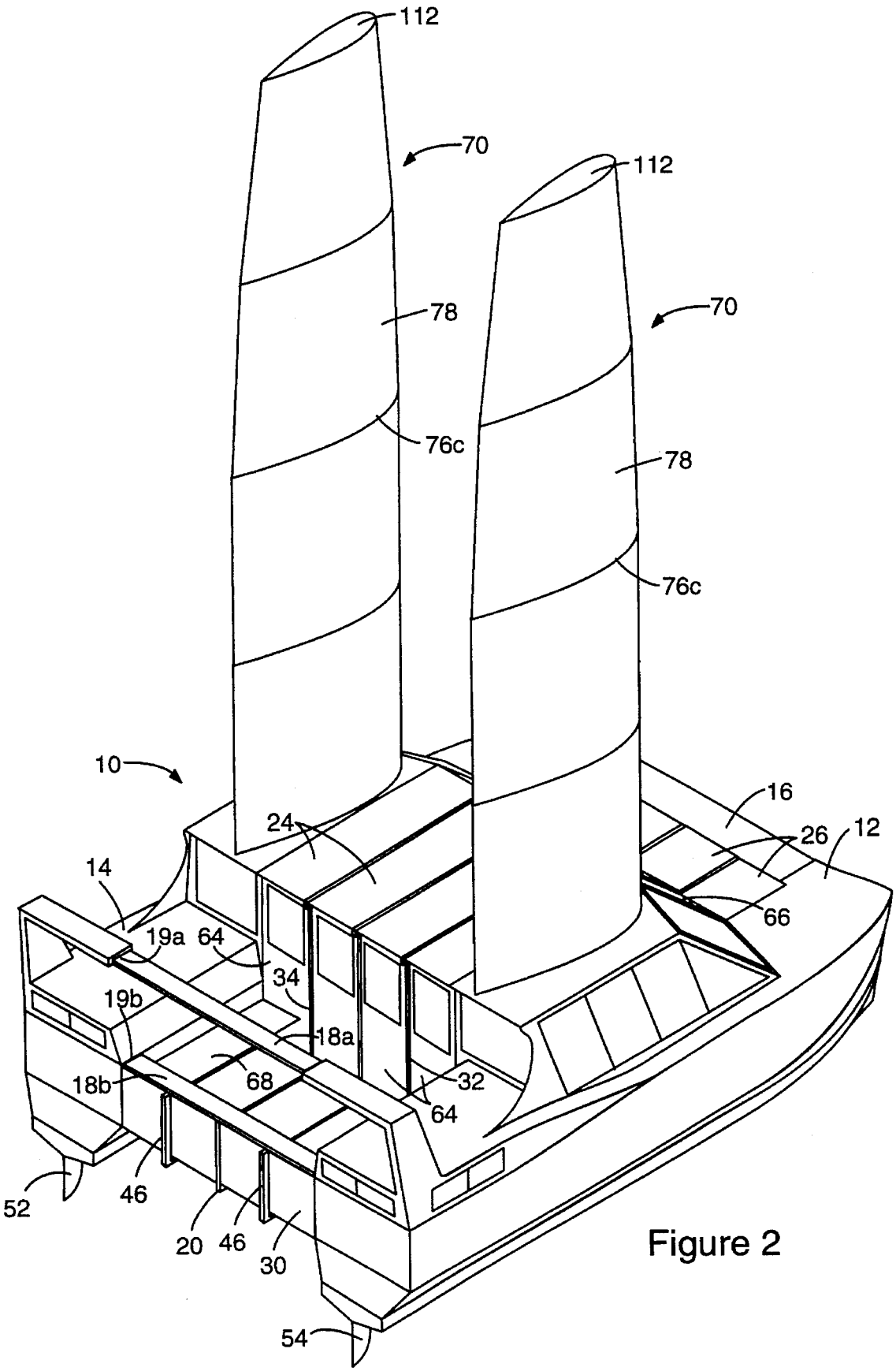
FIG. 2 is a diagrammatic orthographic view of the boat shown in FIG. 1 in an unfolded or extended position with two mast assemblies in the raised position.
Figure 3A:
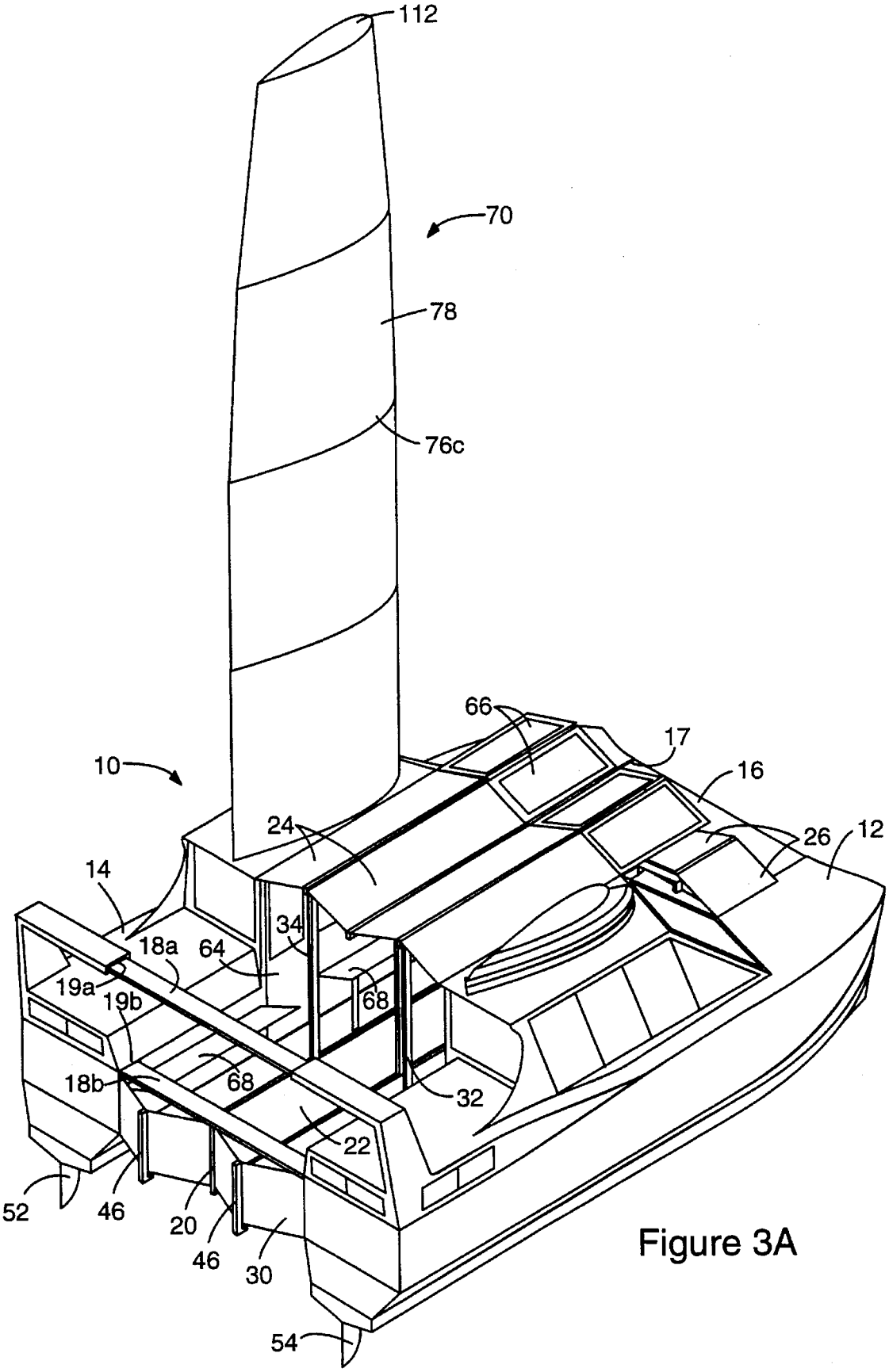
FIG. 3A is a diagrammatic orthographic view of the boat shown in FIG. 1 in a partially closed or folded position with one of the mast assemblies lowered.
Figure 3B:
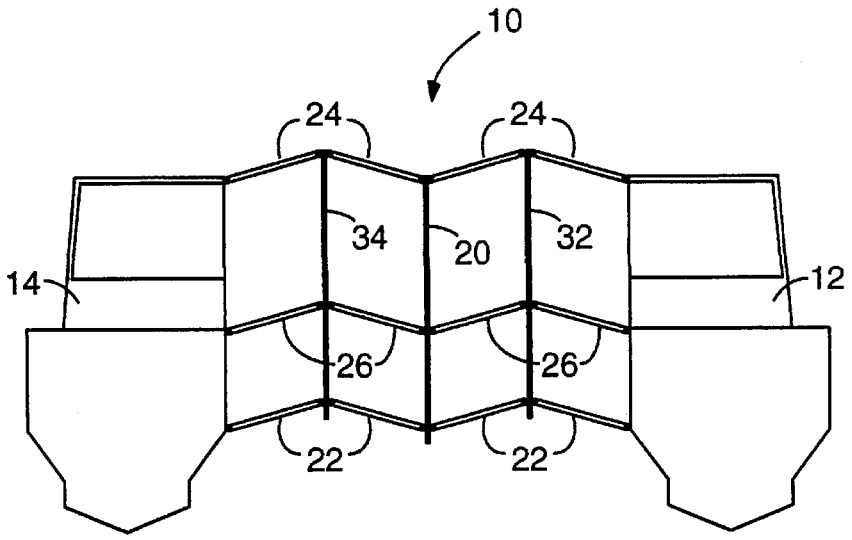
FIG. 3B is a cross sectional diagrammatic view of the boat shown in FIG. 3A showing the pivotal connections between the elements of the boat.
Figure 4:
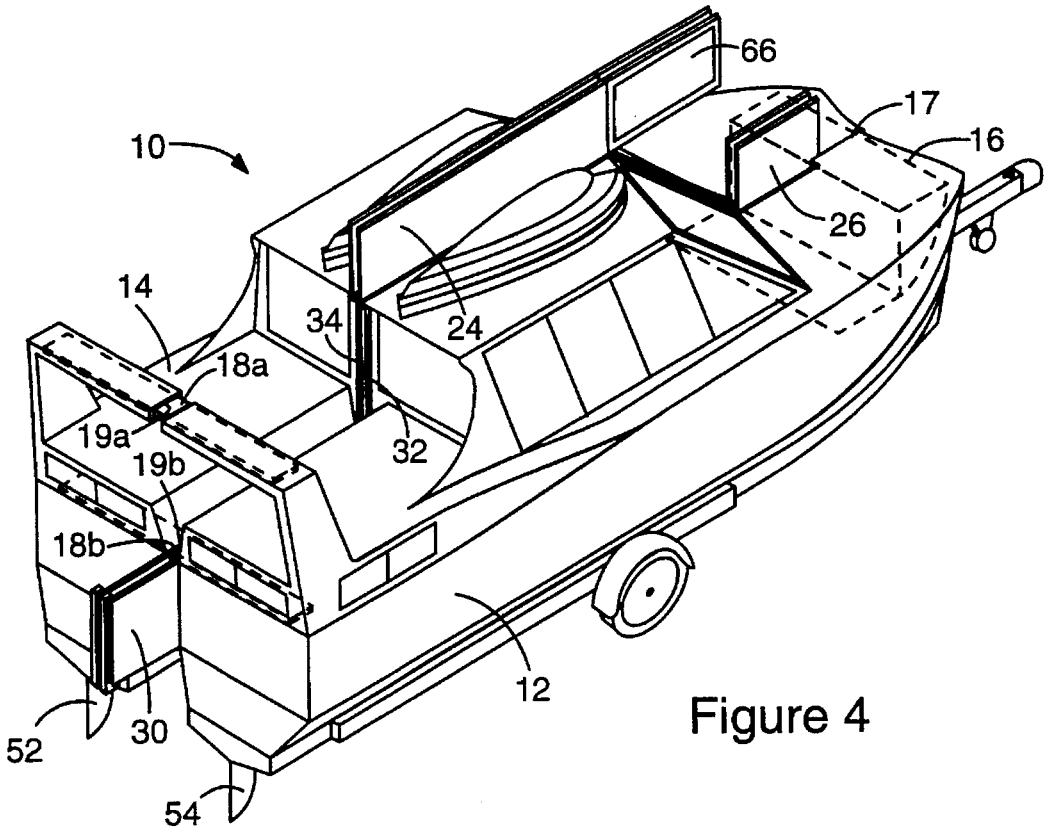
FIG. 4 is a diagrammatic orthographic view of the boat shown in FIG. 1 in a folded or closed position on a trailer.

FIG. 2 illustrates the hulls in a fully extended position, FIGS. 3A and 3B illustrate the hulls in the partially folded position, and FIG. 4 illustrates the hulls in the fully folded position. The accordion style folding of the panels is made possible by the way in which the panels, frames, and hulls are interconnected and is best illustrated by the sequence of FIGS. 2–4. Central frame 20 is fixed longitudinally to and between telescoping beams 16 and 18*b* at lateral midpoints of telescoping beams 16 and 18*b*. Telescoping beams 16, 18*a*, and 18*b* are slidably connected to hulls 12 and 14 such that as the boats width is reduced, beams 16, 18*a*, and 18*b* nest respectively into openings 17, 19*a*, and 19*b* in the hulls. Forward beam panels 28 (not visible in FIGS. 2–4) and aft beam panels 30 also interconnect central frame 20 with hulls 12 and 14. Beam panels 28 and 30 are pivotally connected to and between central frame 20 and hull 12 and 14 preferably along vertical axes relative to hulls 12 and 14 such that as the boat is moved from the extended position to the folded position, aft beam panels 30 fold aft and forward beam panels 28 fold forward accordion style. In other words, as shown in FIG. 3A, aft beam panels 30 fold in a manner similar to a pair of bifold doors with a pair of forward beam panels 28 and aft beam panels 30 being attached between central frame 20 and each of the hulls.

Since central frame 20 is fixed to the lateral midpoints of telescoping beams 16 and 18*b* and pivotally connected to beam panels 28 and 30 along vertical axes, central frame 20 is prevented from moving vertically relative to the hulls. Also, since beam panels 28 and 30 interconnect hulls 12 and 14 and are pivotally interconnected along vertical axes, hulls 12 and 14 are held by beam panels 28 and 30 in an upright relationship relative to one another throughout the folding and unfolding process. Although beam panels 28 and 30 are described and shown in this embodiment as being pivotally connected along vertical axes, this is not a requirement of the invention. However, if the axes along which the beam panels are pivotally connected are at an angle relative to vertical, it should be understood that any vertical component of the axes would provide the above described function of maintaining the upright relationship of the hulls. Alternatively, in other embodiments, the telescoping beams may be relied upon to provide the function of maintaining the upright relationship.

As shown in FIG. 2, when the hulls are in their fully extended position, the cabin deck panels 22, cabin roof panels 24, and foredeck panels 26 all lay flat or substantially horizontal and in parallel planes. Forward beam panels 28 (not visible in FIG. 2) and aft beam panels 30 are in parallel, substantially vertical planes which are substantially perpendicular to cabin deck panels 22, cabin roof panels 24 and foredeck panels 26. When these vertically positioned beam panels 28 and 30 are latched to the deck panels, a rigid cabin structure is formed between hulls 12 and 14.

Referring to FIGS. 3A and 3B, as the hulls are moved from the extended position to the folded position, the cabin deck panels 22, cabin roof panels 24, foredeck panels 26, forward beam panels 28 (not visible in FIGS. 3A and 3B), and aft beam panels 30 fold accordion style to reduce the overall width of the vessel. As shown in FIGS. 3A and 3B, cabin deck panels 22, cabin roof panels 24, and foredeck panels 26 are pivotally connected to and between central frame 20 and hulls 12 and 14 in a manner similar to that described above for beam panels 28 and 30. However, panels 22, 24, and 26 are pivotally connected to central frame 20 and the hulls along axes parallel to the longitudinal axis of the hulls. Also, as shown in FIG. 3B, each of cabin deck panels 22, cabin roof panels 24, and foredeck panels 26 have one longitudinal edge pivotally connected to either starboard frame 32 or port frame 34 along an axis parallel to the longitudinal axes of the hulls. As shown in FIG. 3A, with this arrangement, as the boat is moved from the extended position to the folded position, both starboard frame 32 and port frame 34 are caused to move vertically upward. Since all of panels 22, 24 and 26 are connected to either starboard frame 32 or port frame 34, these frames coordinate the folding of these panels forcing them to fold simultaneously. This arrangement still allows the width of the boat to be reduced as the boat is moved from the extended position to the folded position, however, since panels 22, 24, and 26 interconnect the hulls along axes parallel to the longitudinal axes of the hulls, the hulls are maintained or held in a parallel, longitudinally fixed relationship throughout the folding and unfolding operation.

Referring now to FIG. 4, when the hulls are moved to their fully drawn together position, the deck and roof panels 22 (not visible in FIG. 4), 24, and 26 are pivoted such that they extend substantially vertically and the beam panels 28 (not visible in FIG. 4) and 30 are pivoted forward and aft, respectively, such that all of the panels are folded accordion style. Frames 32 and 34 are pivoted to locations above and slightly to each side of central frame 20. The deck and roof panels 22, 24, and 26 are in substantially parallel planes in the vertical longitudinal direction and are substantially coplanar with their corresponding forward and aft beam panels 28 and 30. Telescoping beams 16, 18*a*, and 18*b* respectively nest into openings or spaces 17, 19*a* and 19*b* provided in hulls 12 and 14 which have a cross section slightly larger than the cross section of the telescoping beams. Alternatively, the telescoping beams may be slidably attached to an exterior surface of the hulls such that when in the folded position, the telescoping beams are positioned adjacent to certain portions of each hull rather than nested within the hulls.

The telescoping beam cross sections may take on a wide variety of shapes and dimensions depending on the size of the loads they will be required to carry. By way of example, in the embodiment shown, telescoping beam 16 has a D-shaped cross section which provides storage space within beam 16. Openings 17 have a similar D-shaped cross section slightly larger than beam 16 such that beam 16 nests into hulls 12 and 14 when the boat is in the folded position. Alternatively, in other embodiments, the cross section of the telescoping beam may be made large enough to provide usable cabin space such as, for example, a berth. Also, although the telescoping beams have been described as nesting into openings within the hulls, it should be understood that alternatively the portions of the hulls associated with the telescoping beams may nest into the telescoping beams.

Figure 5A:
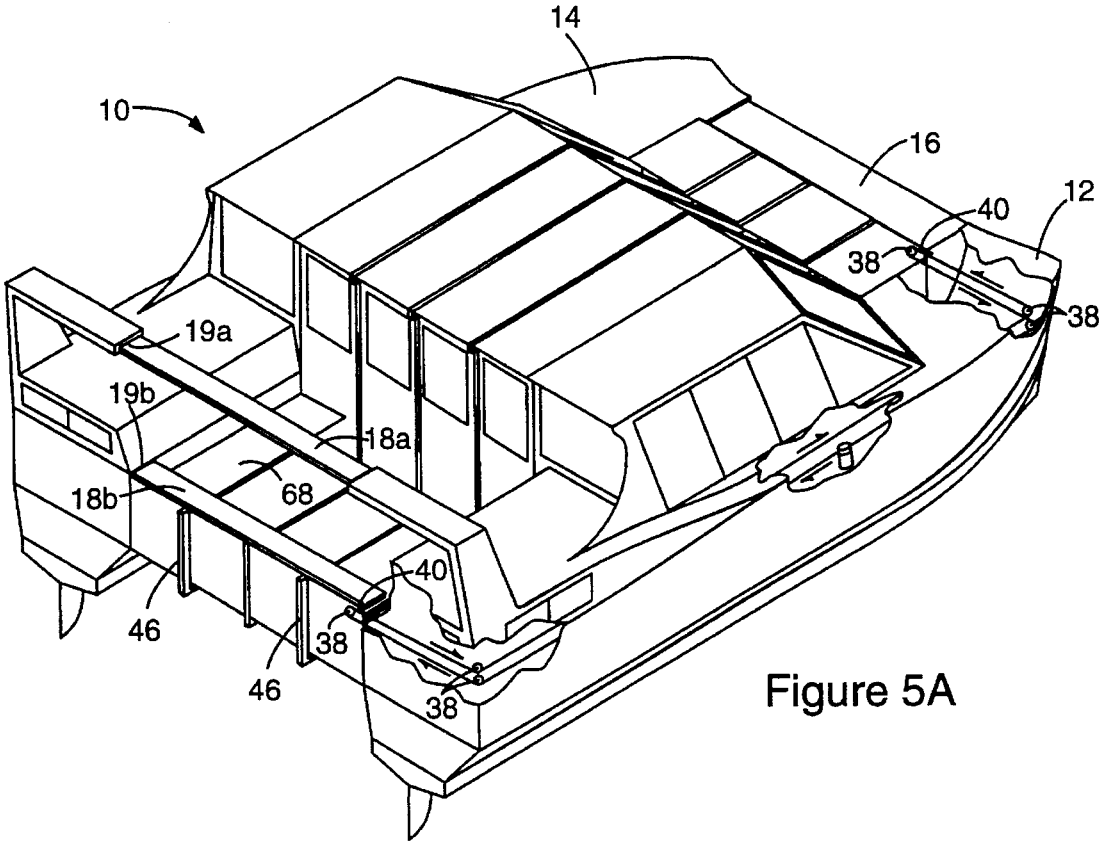
FIG. 5A is a schematic view of a preferred embodiment of a folding arrangement suitable for collapsing the width of the boat.
Figure 5B:
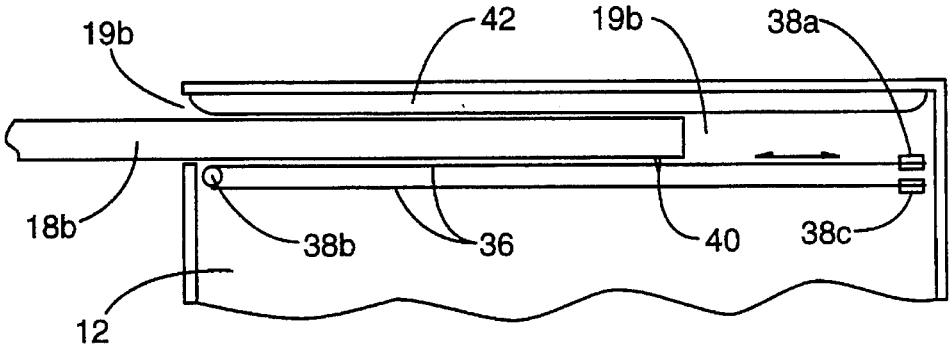
FIG. 5B is a schematic detail cross sectional view of the folding arrangement of FIG. 5A showing connection points and arrangements of width varying elements.

In order to fold and expand the decks, one preferred embodiment of the present invention uses a cable and pulley system as shown in FIGS. 5A and 5B. In order to provide independent control of the folding process for the port and starboard hulls, this embodiment utilizes two separate cable arrangements. By providing this independent control, for example, the port hull may be folded first leaving space for the passengers on the starboard portion of the deck. The passengers may then move to the port hull to allow the starboard half of the decks to be folded. The cable arrangements for each of the hulls are mirror images of one another so only the starboard side deck folding cable arrangement will be described.

Referring to FIG. 5A, the deck folding cable arrangement includes a continuous cable 36 passing around deck folding pulleys 38 at points adjacent to the spaces 17, 19*a*, and 19*b* in the hull in which the fore and aft telescoping beams 16, 18*a*, and 18*b* nest, and adjacent to the opposite sides of the hull. The cable is fixedly attached to telescoping beams 16, 18*a*, and 18*b* at attachment points 40.

One preferred embodiment of an arrangement for slidably attaching beams 16, 18*a*, and 18*b* to the hulls is illustrated in FIG. 5B. Beam 16, 18*a*, and 18*b* are slidably attached to the hulls in a similar manner and therefore, only the aft beam attachment for beam 18*b* will be described. As shown in FIG. 5B, telescoping aft beam 18*b* is slidably attached to hull 12 by guides 42. These guides may take a wide variety of forms so long as they guide beam 18*b* into and out of the opening 19*b* provided within hull 12. As mentioned above, deck folding pulleys 38, in this case including pulleys 38*a–c*, are attached to the hull adjacent opposite sides of hull 12 and adjacent the opening in hull 12 for beam 18*b*. Continuous cable 36 is routed through pulleys 38 such that cable 36 runs back and forth through pulleys 38 substantially the full width of hull 12 adjacent to the opening in which beam 18 is intended to nest. As shown in FIG. 5B, when cable 36 is moved in a first direction it moves from pulley 38*a* around pulley 38*b* on the left side of the hull and then around pulley 38*c*. As mentioned above, telescoping beam 18*b* is attached to cable 36 at attachment point 40 and cable 36 is arranged such that when cable 36 is moved in the first direction, aft telescoping beam 18*b* is caused to be drawn into the space in hull 12. More specifically, since the cable is fixed to beam 18*b* at attachment point 40, movement of cable 36 in the first direction pulls the end of beam 18*b* further into the hull. When the cable is moved in the other direction, telescoping beam 18*b* egresses from hull 12 into the open, unfolded position.

With the above described deck folding arrangement, a bi-directional deck folding winch 44 may be used to move cable 36. Winch 44 may be either manually operated or power driven using electric, hydraulic, or other such power winches. Since cable 36 is a continuous cable and since both forward telescoping beam 16 and aft telescoping beam 18*b* are attached to cable 36 in a similar manner to that described above, as winch 44 is operated in the first direction, both beams 16 and 18*b* are drawn into the spaces in hull 12 at an equal rate, thereby causing the width of the boat to be reduced. Also, when winch 44 is operated in the opposite direction, both beams 16 and 18*b* are withdrawn from hull 12 at an equal rate, thereby causing the boat to move into the open or unfolded position.

Figure 5C:
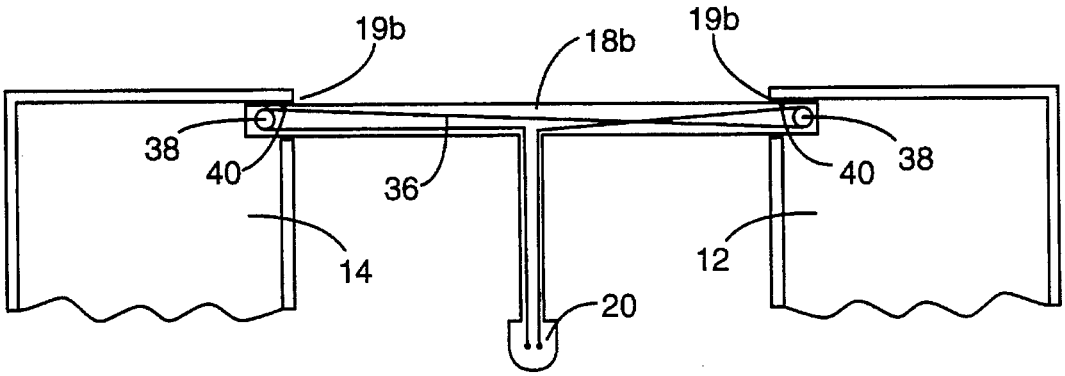
FIG. 5C is a schematic detail cross sectional view of another embodiment of a folding arrangement suitable for collapsing the width of the boat.

Other embodiments of the invention may utilize other arrangements for folding the panels such as hydraulic and pneumatic rams or other cable and pulley arrangements and still remain within the spirit and scope of the present invention. For example, although the deck folding arrangement has been described as using two separate cables, with each cable associated with one of the hulls, this is not a requirement. As illustrated in FIG. 5C, a single cable may be used to move both hulls between the folded and unfolded position simultaneously. In this case, pulleys 38 are mounted at the outer extremes of beam 18*b* and cable 36 is routed around pulleys 38 such that cable 36 runs back and forth along beam 18*b* substantially the full length of beam 18*b*. Cable 36 is fixed to hulls 12 and 14 at attachment points 40 shown in FIG. 5C such that when cable 36 is moved in a first direction, hulls 12 and 14 are drawn together with beam 18*b* nesting into openings 19*b*. In this arrangement cable 36 would also be routed along central frame 20 to forward telescoping beam 16 where it would have a similar cable layout (not shown in FIG. 5C). This arrangement would cause both hull 12 and 14 to be drawn together or apart simultaneously with each of the telescoping beams nesting into their respective openings in the hulls.

Figure 5D:
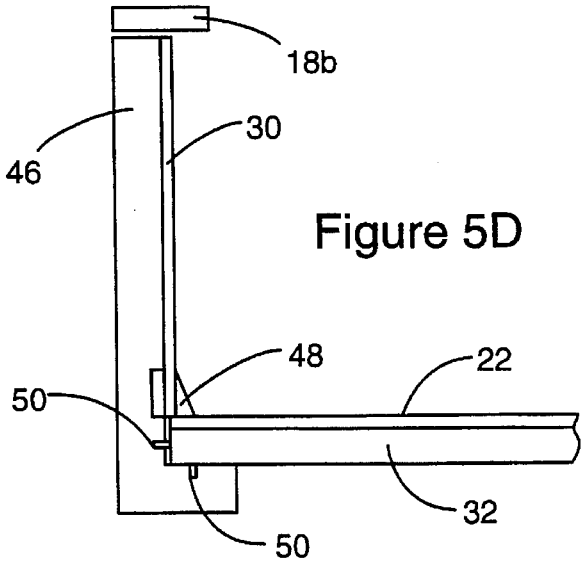
FIG. 5D is a schematic detail cross sectional view of a preferred embodiment of a deck latching arrangement in accordance with the present invention.

Referring to FIGS. 5A and 5D, a plurality of deck folding latch arrangements may be used to secure the deck folding system in the open position. Since each of the latch arrangements of the embodiment shown are similar, only the starboard, aft arrangement will be described in detail. In this arrangement, a frame support 46 is pivotally connected between the two starboard aft beam panels 30. Frame support 46 acts to coordinate the folding of these two beam panels which it pivotally connects. Frame support 46 provides support and a stopping point for starboard frame 32 as starboard frame 32 pivots down into the unfolded position. As shown in FIG. 5D, a latch 48 is attached to frame support 46 and is positioned such that latch 48 latches starboard frame 32 into the fully unfolded position once frame 32 engages, or is stopped by frame support 46. Also, this deck latching arrangement may include one or more deck folding springs 50 which are arranged such that when the deck is in the extended, unfolded position and latch 48 is disengaged, the starboard frame 32 and frame support 46 are pushed slightly out of the fully extended position. This pushing of frame 32 and frame support 46 by springs 50 facilitates smooth deck folding by pushing the deck, roof, and beam panels slightly out of being aligned in parallel planes. Although only one specific embodiment of a deck latching arrangement has been described in detail, it should be understood that the deck latching arrangement may take a wide variety of alternative forms including pins or bolts which are manually removed, latches placed in other locations, or other such arrangements.

Because the deck, roof, and beam panels are connected to the hulls and frames as described above, they are forced to fold accordion style in coordination with the movement of the telescoping beams. Also, since the beam panels 28 and 30 are substantially perpendicular to the deck and roof panels 22, 24, and 26, the entire folding structure remains stable as the width of the boat is being folded or unfolded. In other words, the vertical and longitudinal relationship of the two hulls is maintained throughout the folding and unfolding process. As mentioned above, this provides stability that allows the folding process to take place while the vessel is still on the water under light sail or motoring. The hulls are maintained in an upright, longitudinally fixed, parallel relationship throughout the folding and unfolding operation so that passengers may comfortably remain on board in or on the hulls. Therefore, the folding and unfolding process can take place completely after launching and prior to trailering by simply clearing the folding deck and cabin area of passengers and provisions and operating the deck folding winches in the appropriate direction. This dramatically reduces the time and labor required to launch and trailer the boat compared with other variable width boats while also providing a much larger cabin and deck area compared to other boats of similar length.

In the embodiment chosen for the purposes of illustration, a total of four cabin deck panels, four roof panels, four foredeck panels, four forward beam panels, and four aft beam panels are provided. It is to be understood that the actual number of such panels may vary widely in accordance with the requirements of a particular design and still remain within the spirit and scope of the present invention. However, typically the number of each of the types of panels would be an even number in the range of two to eight, and, the number of frames may vary depending on the number of panels. Also, although the embodiment of the present invention described includes cabin deck panels, cabin roof panels, and foredeck panels, this is not a requirement. For instance, in the case of a boat without a foredeck, the present invention would equally apply if no foredeck panels were included.

It should also be understood that the present invention would equally apply to a boat in which larger versions of the telescoping beams are used to eliminate the need for the forward and/or aft beam panels. As mentioned above, these telescoping beams may be made to have a cross section large enough to provide storage space or even, in some cases, cabin space such as, for example, a berth. In an extreme example of this, the entire width varying arrangement may be made up of a single, very large cross section, telescoping beam which forms the entire cabin and deck area between the hulls when the boat is in the extended position, and nests into the hulls when the boat is in the closed position.

Furthermore, although the embodiment described above incorporates structural panels, telescoping beams, and beam panels as components making up the width varying arrangement used to interconnect the hulls, these specific elements are not a requirement of the present invention. Instead, it should be understood that other structural elements such as frames, trusses, or the like may replace some or all of the panels and beams of the embodiment described above and still remain within the scope and spirit of the present invention. This would be the case as long as the structural elements used to make up the width varying arrangement maintain the hulls in an upright, longitudinally fixed, parallel relationship throughout the folding and unfolding of the boat. It should also be understood that although the described embodiment contemplates using deck and roof panels to form usable deck and cabin space between the hulls when the boat is in the extended position, this is not a requirement. In fact, in some situations, it may be desirable to use light weight frames, beams, trusses, or other structural elements to replace the panels and beams in order to produce a boat with much less windage than the above described embodiment.

Figure 6A:
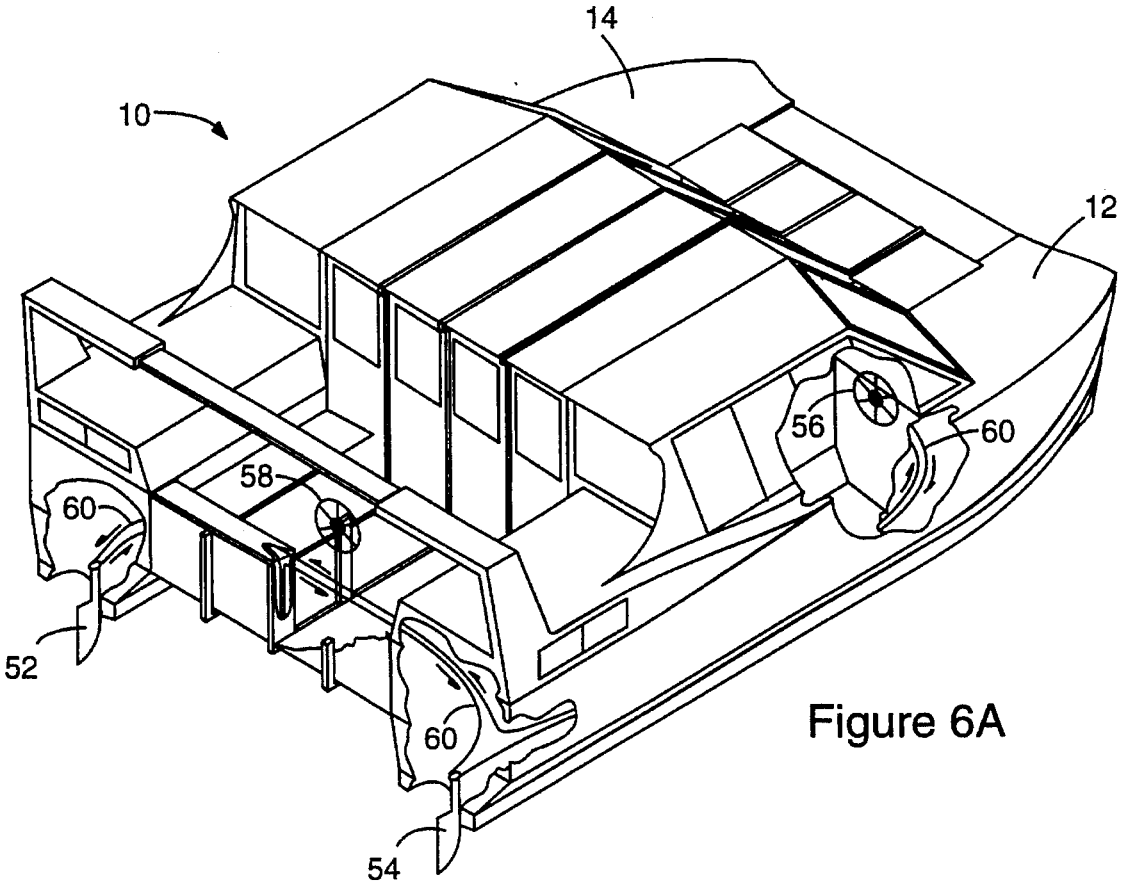
FIG. 6A is a schematic view of a preferred embodiment of a rudder steering arrangement.
Figure 6B:
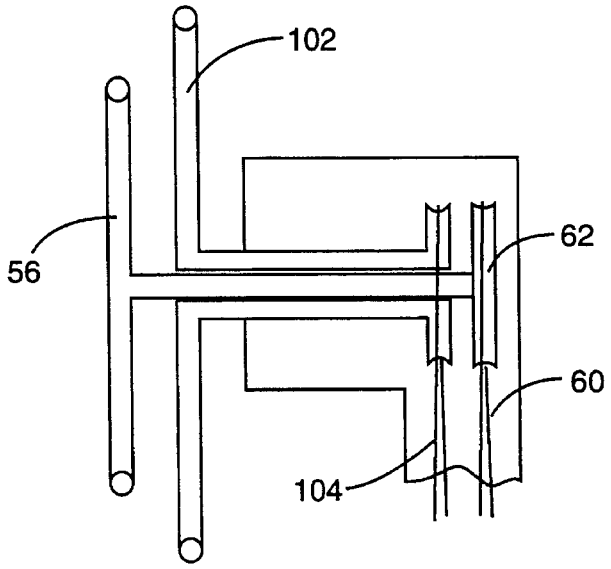
FIG. 6B is a schematic detail cross sectional view of a steering control suitable for controlling the rudder steering arrangement of FIG. 6A.

Referring next to FIGS. 6A and 6B, a preferred embodiment of a rudder steering system for a variable width boat in accordance with the present invention will be described. In this embodiment, a port rudder 52 and a starboard rudder 54 are provided. Conventional wheel type helms 56 and 58 are provided in the starboard hull cabin and the cockpit deck area, respectively. The cockpit helm 58 is mounted to the central frame 20 and directly above central frame 20 such that it does not interfere with cabin deck panels 22 during the folding process. Wheels 56 and 58 are coupled to the rudders by a conventional steering guide cable 60. The steering system provides steering control in the folded and extended positions, along with throughout the folding and unfolding operations. As shown in FIG. 6B, the steering cable 60 is turned around a pulley boss 62 driven by wheel 56. Cable 60 is next routed to wheel 58 where cable 60 is turned around another pulley boss driven by wheel 58 in a similar fashion as was described for wheel 56. Cable 60 is arranged to transmit any movement of cable 60 at wheel 56 to wheel 58 in an equal amount. Cable 60 is also attached to the deck panels and/or frames such that it does not interfere with the deck folding process and such that steering control of the rudders is maintained throughout the deck folding process. The cable continues from wheel 58 to port rudder 52, from port rudder 52 to starboard rudder 54, and from starboard rudder 54 to the wheel 56 in a similar manner. This arrangement results in a continuous cable system which, when wheel 56 or 58 are rotated, cable 60 will translate a corresponding amount of motion to both rudders thereby providing steering control of the rudders.

With the above described rudder steering system, the folding or unfolding operation can be conducted while the vessel is under light sail or motoring and still maintain steering control of the rudders. This may be desirable in situations where it is beneficial to reduce the width of the boat such as when maneuvering into port or other restricted spaces. It also makes it easy to perform the folding operations on the water when preparing for trailering or entering a marina slip. In the case of trailering, this capability significantly reduces the time and labor required to trailer the boat compared to other variable width boats.

Although the rudder steering system has been described as a cable system, it should be understood that this is not a requirement. Alternatively, other embodiments of the invention may incorporate other steering systems such as hydraulic and pneumatic systems, electronically controlled systems, or other cable systems. However, preferably steering control is maintained throughout the folding process. Also, other embodiments may utilize only one helm position or helm positions in other locations within the boat.

Many additional features may be provided in the width varying arrangement depending on design requirements. For instance, as best shown in FIGS. 2 and 3A, a plurality of door panels 64 and windshield panels 66 may be provided to enclose the cabin. In one preferred embodiment, windshield panels 66 are extensions of cabin roof panels 24 with windshield panels 66 being pivotally connected to the forward edge of corresponding cabin roof panels 24. In the fully extended or unfolded position, windshield panels 66 may be pivoted down to meet foredeck panels 26, thereby enclosing the front of the cabin area. When the decks are to be folded, windshield panels 66 are pivoted up to a position such that they are in a parallel plane with roof panels 24. This allows windshield panels 66 to fold in coordination with roof panels 24. Door panels 64 may be pivotally connected to hulls 12 and 14 at the rear of the cabin area such that when doors 64 are pivoted against the hulls, as shown in FIG. 3A, they are clear of the folding deck panels and do not interfere with the folding and unfolding process. When the boat is in the extended position, doors 64 may be closed such that they enclose the back of the cabin area between hulls 12 and 14, as shown in FIG. 2.

In another feature, seating and tables that are attached to the width varying arrangement in the appropriate locations may automatically fold into place during the folding process. In one preferred embodiment, cockpit seating panels and cabin seating panels 68 are pivotally connected to the hulls and port or starboard frames 32 and 34 along axes parallel to the pivotal connections of cabin deck panels 22 and cabin roof panels 24, as shown best in FIG. 3A. This arrangement causes seating panels 68 to automatically fold in coordination with the folding of the deck and roof panels. Other embodiments may incorporate a wide variety of configurations of folding seating, tables, and other components so long as they do not interfere with the folding process.

Still another feature may incorporate weather sealing flanges on, for example, the top of port and starboard frames 32 and 34 that would automatically seal the hinge points of the folding decks. This encloses and protects the cabin area from the elements when the boat is in the fully extended position. All of the above mentioned additional features, while not structurally necessary, add significantly to the convenience and comfort provided. These and other similar arrangements become clear to one skilled in the art from the examples described above and therefore remain within the spirit and scope of the invention.

Figure 7:
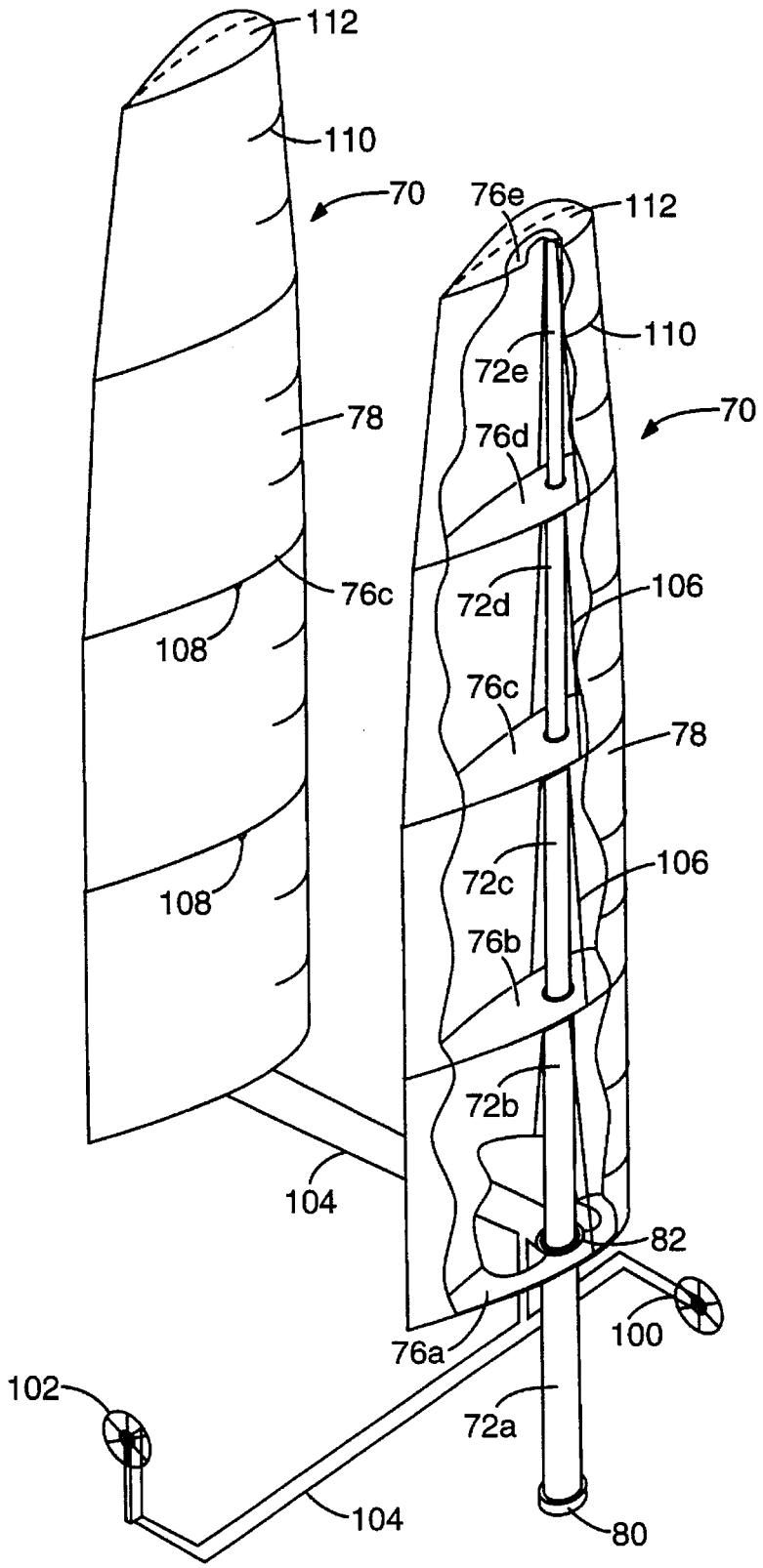
FIG. 7 is a schematic orthographic view of a pair of mast assemblies in accordance with a preferred embodiment of the present invention showing mast sections, sails, and a sail steering arrangement with the mast assemblies in the extended or raised position.
Figure 8:
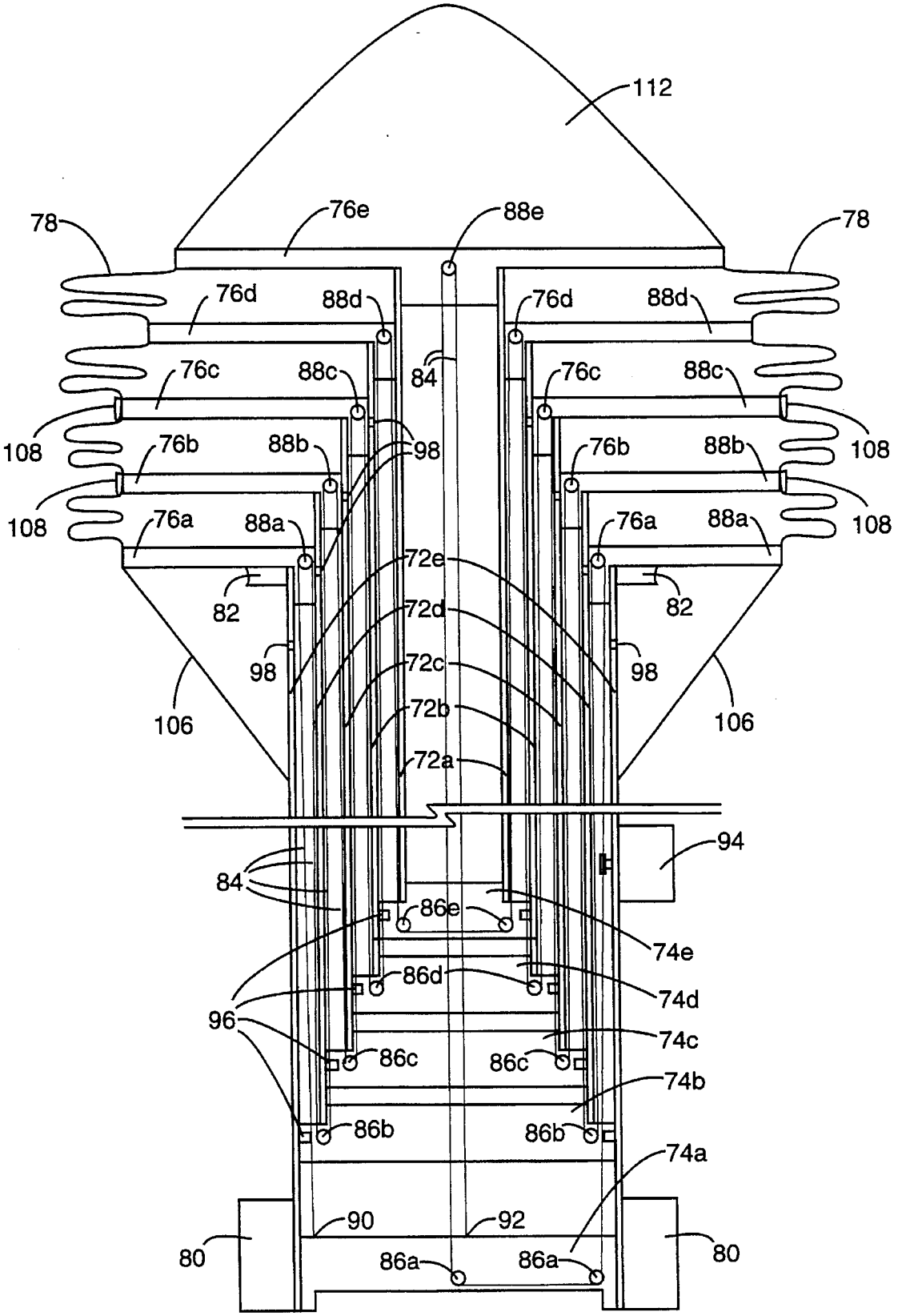
FIG. 8 is a diagrammatic cross sectional view of one of the mast assemblies shown in FIG. 7 in the lowered, collapsed position.

In a separate aspect of the invention, a preferred embodiment of a sailboat version of the present invention utilizes a starboard and a port telescoping mast assembly each of which support an associated wing sail and each of which are generally indicated by reference numeral 70. Referring to FIGS. 7 and 8, each of the two telescoping mast assemblies include a plurality of telescoping mast sections 72*a–e*. In the described embodiment, five mast sections are provided corresponding to mast sections 72*a* through 72*e*. Each consecutive mast section has a cross section smaller than the previous mast section allowing the mast sections to collapse telescopically into the next larger mast section such that all of the mast sections collapse telescopically into the largest mast section 72*a*. Although this embodiment utilizes five mast sections, the actual number of mast sections may vary widely in accordance with the requirements of a particular design and still remain within the scope of the present invention. Also, although the mast sections illustrated have a circular cross section, the cross section of the mast section may also vary widely and still remain within the scope of the invention.

In the embodiment shown, each mast section has a mast section base cap 74*a–e* (shown in FIG. 8) at its lower end and a wing sail rib 76*a–e* at its upper end, each wing sail rib having a peripheral edge forming a foil shape. A covering or sail material 78 surrounds each entire mast assembly and attaches to the outer peripheral edge of each of the wing sail ribs forming a fully enclosed wing shape when the mast is in the raised position. A mast base bearing 80 and a mast roof bearing and pulley 82 attach the largest cross sectional mast section 72*a* to its corresponding starboard or port hull. Beatings 80 and 82 are positioned to allow the entire mast and sail assembly to rotate around its vertical axis within the hull. Although, two bearings are described for rotationally connecting mast section 72*a* to its hull, other specific arrangements such as bushings or combinations of bushings and bearings may be used to rotationally attach the mast to the hull and still remain within the scope of the present invention. Also, although the preferred embodiment of the telescoping mast is rotatable, this is not a requirement.

As will be described in more detail hereinafter, the telescoping masts include a mast raising arrangement which allows the mast to be moved between its raised position and its lowered position by operating the mast raising arrangement in the appropriate direction. Therefore, the raising and lowering of the mast can take place completely after launching and prior to trailering by simply operating the mast raising arrangement in the appropriate direction. Since the sail is attached to the telescoping mast as described above, this raising or lowering of the mast also fully raises or lowers the sail. In the case of a trailerable sailboat, this dramatically reduces the time and labor required to launch and trailer the boat compared with other mast arrangements by completely eliminating the need to dismount the sails, rigging, and mast. Also, this allows the mast and sail to be quickly and easily lowered for bridges or other obstacles or in the case of sudden severe weather changes.

Referring to FIG. 8, the largest mast section 72*a* is attached to the hull floor by mast base bearing 80. The upper end of mast section 72*a* is attached to the cabin roof by mast roof bearing 82 which, in this embodiment, has a large diameter to carry any large loads that may be caused by the sail. The combination of these two beatings secures mast section 72*a* in place and transfers the loads from the sail to the hull. These bearings also allow the masts to be rotated continuously a full 360 degrees. This provides significantly improved maneuverability while under sail by allowing smother jibes and other such maneuvers. This also provides the rather unique ability to easily sail backwards which can be very helpful when leaving a slip or dock.

Still referring to FIG. 8, when in the lowered position, each of the consecutively smaller cross sectional mast sections of the mast nest into the next larger mast section. Mast section base caps 74*a–e* and wing sail ribs 76*a–e* act as guides to maintain the cross sectional positioning of the mast sections. Wing sail ribs 76*a–e* are stacked vertically with sail 78 collapsing accordion style. Therefore, in the collapsed position, since the largest mast section 72*a* is mounted within its associated hull, the entire mast and sail assembly protrudes only slightly above the cabin roof as best shown in FIG. 4. This allows the vessel to be trailered without having to in any way dismount the sail, mast, or any rigging. This significantly reduces the time required to launch or trailer the sailboat compared to other trailerable sailboats.

In order to raise and lower the mast and sail, one of the presently preferred embodiments of the invention uses a single cable and pulley mast raising system as shown in FIG. 8. This cable and pulley system includes a mast raising cable 84, a plurality of mast section base cap pulleys 86*a–e,* and a plurality of wing sail rib pulleys 88*a–e*. One end of cable 84 is attached to the base of the largest mast section 72*a* at attachment point 90. The cable is routed up between mast section 72*a* and 72*b* around wing sail rib pulley 88*a* at the upper end of the largest mast section 72*a*. The cable continues down between mast section 72*a* and 72*b* passing through base cap pulley 86*b* in the mast section base cap 74*b* at the lower end of mast section 72*b*. Next, the cable is threaded up through the inside of mast section 72*b* between mast section 72*b* and 72*c* to wing sail rib pulley 88*b* at the upper end of mast section 72*b* in the same manner as was done for mast section 72*a*. This layout of the cable continues for each of the mast sections until the cable reaches the base cap pulley 86*e* at the base of the smallest mast section 72*e*. From this point the cable is routed over to a second base cap pulley 86*e* at the opposite side of base cap 74*e*. The cable continues up between mast section 72*d* and mast section 72*e* to wing sail rib pulley 88*d*. The cable runs from the wing sail rib pulley of each mast section to the mast section base cap pulley of that mast section and then to the next consecutive wing sail rib pulley at the top of the next larger mast section. When the cable reaches mast section base cap pulley 86*a* at the lower end of the largest mast section 72*a,* the cable continues around a second mast section base cap pulley 86*a* at the center of base cap 74*a*. From here the cable extends up through the center of all of the mast sections to wing sail rib pulley 88*e* at the top of the smallest mast section 72*e*. Finally, the cable continues back down to mast section base cap 74*a* of the largest mast section 72*a,* where cable 84 is attached at attachment point 92.

The above described mast raising system also includes a bi-directional mast raising winch 94. Winch 94 may be manually operated or power driven using electric, hydraulic, or other such power winches. Also, it should be understood that the mast raising winch may be located in a variety of positions depending on the specific cable layout used and the space available. In the example shown in FIG. 8, mast raising winch 94 is attached to mast section 72*a* at a point along the length of mast section 72*a* on the side of mast section 72*a* opposite attachment point 90. Cable 84 is operably attached to winch 94 between the mast section base cap pulley 86*a* and the wing sail rib pulley 88*a* on the opposite side of mast section 72*a* as attachment point 90 such that winch 94 draws cable 84 up or down between mast section 72*a* and mast section 72*b* depending on the direction winch 94 is operated. With the above described system, the raising and lowering of the mast and sail can be conducted by simply operating the mast raising winch in the appropriate direction. This allows the operator to quickly lower the masts and sails for obstacles such as bridges. More significantly, this system eliminates the need to dismount the mast, sail, or any rigging when trailering the boat which dramatically reduces the time and labor required to trailer and launch the sailboat.

When raising the mast, winch 94 is operated in a first direction which shortens the length of cable 84 between winch 94 and attachment point 90. This forces each of the mast sections to be lifted vertically with respect to the next larger mast section. The length of cable removed from between winch 94 and attachment point 90 is added to the cable length between winch 94 and attachment point 92 in an equal amount. This allows the smallest mast section 72*e* to move up vertically in an amount equal to the sum of the relative movements between all of the mast sections. To lower the mast, winch 94 is operated in the other direction. This shortens the length of cable 84 between point 92 and winch 94 drawing the smallest mast section 72*e* down. The length of the cable 84 between winch 94 and point 90 is lengthened in an equal amount allowing the mast sections to collapse telescopically at a cumulative rate equal to that which the smallest mast section 72*e* is drawn down.

In the described embodiment, the mast raising cable runs up one side of the mast, down the other, through the winch, to the top of the smallest mast section, and finally to the largest mast section base. In alternative embodiments, the cable may be routed up and down the mast several times or only once depending on the design load requirements. Further, one or more mast latches 96 may optionally be provided in each mast section base cap. These mast latches may be spring loaded to latch into openings, indicated by reference numeral 98, formed at the top of the next larger mast section. When the mast is moved into the raised position, the mast latches 96 for each mast section automatically engage latching each mast section in the raised position so that the mast raising cable does not have to carry the large loads generated while sailing. In this embodiment, latch release cables which, for example, may be routed through the center of the mast sections, would be required to disengage the latches when lowering the masts. By providing independent control of the latches for each mast section, this arrangement would also allow particular sections of the mast to be collapsed while maintaining the other sections in the raised position.

Although the embodiment of the telescoping mast described above includes wing sail ribs for supporting a wing sail, this is not a requirement of the present invention. Instead, the wing sail ribs 76*a–e* may be replaced with mast section top caps which do not include peripheral edges for supporting a wing sail. This type of telescoping mast may be used, for example, with conventional flat sails. Also, although the embodiment described uses a cable system to raise and lower the mast, this is not a requirement. In fact, other mast raising arrangements such as hydraulic or pneumatic systems may be incorporated and still remain within the spirit and scope of the present invention. Alternatively, in another embodiment of the telescoping mast, the mast raising arrangement may be provided by using externally threaded mast sections which are threaded into internally threaded versions of mast section top caps attached to the top end of each mast section. In this embodiment, the mast would be raised by rotating each mast section in one direction relative to the next larger mast section and would be lowered by rotating each mast section in the opposite direction relative to the next larger mast section.

Referring back to FIG. 7, a mast steering system for the mast and wing sail will be described. A continuous cable system similar to the system described above for the rudder steering system is provided. The mast steering system includes mast steering wheels 100 and 102 provided in the cockpit and starboard hull cabin, respectively, and a mast steering cable 104. Cockpit mast steering wheel 102 is mounted coaxially with cockpit helm wheel 58 and mounted to central frame 20 such that it does not interfere with the deck panels during the folding process. Cabin mast steering wheel 100 is also mounted coaxially with its associated helm wheel 56 as shown in FIG. 6B such that helm wheel 56 steerably controls its associated cable 60 and mast steering wheel 100 steerably controls mast steering cable 104. Cockpit mast steering wheel 102 and cabin mast steering wheel 100 are coupled to mast roof bearing and pulleys 82 on each of the masts by continuous mast steering cable 104 in a manner similar to that described above for the rudder steering cable system. Mast steering cable 104 is attached to the deck panels and frames such that it does not interfere with the folding and unfolding of the boat while providing steering control of the masts throughout the deck folding and unfolding process. Also, by using a continuous cable for mast steering cable 104, the system provides continuous 360 degree control of the sails. This is desirable to perform smoother jibes and also provides the ability to sail backwards as mentioned above. Although, the mast steering system is described as using a cable system, this is not a requirement. Other arrangements for controlling the rotational position of the mast such as electric motors, hydraulic and pneumatic systems, and the like equally apply and remain within the scope of the present invention.

Many additional features may be provided in the telescoping mast and wing sail system depending on the design requirements. For example, as shown in FIG. 7, a plurality of internal rigging cables or elements 106 may be added to stiffen the mast assembly when the mast is in the raised position. Internal rigging elements 106 may be attached to the peripheral edges of wing sail ribs 76 and certain locations on mast sections 72 such that the internal rigging helps carry the loads generated by the sail when the mast is in the raised position and such that the internal rigging collapses in coordination with sail covering 78 as the mast is lowered. Reefing eyelets 108 may be attached to the edges of some of the wing sail ribs 76 to provide tie down points that would restrict the height to which the mast and sail could be raised. This would provide an arrangement for reefing the sail, that is raising only a portion of the mast and wing sail, for example to reduce sail in heavy weather situations. The above described mast latches may be included to latch the mast sections of the portion of the mast raised in its raised position so that the mast raising cable is not required to carry the large loads generated by the reefed sail. A plurality of leading edge battens 110 may be added as necessary to the leading edge of the sail between wing sail ribs to maintain the leading edge sail shape. And finally, a mast head float cap 112 may be attached to the uppermost wing sail rib. Mast head float cap 112 may be arranged to provide enough buoyancy to prevent the boat from capsizing a full 180 degrees. This may also be arranged to provide a self righting capability such that the boat, if capsized, automatically orients itself such that the wind and waves right the boat. Alternatively, the same benefits may be provided by making the wing sail material waterproof allowing the entire wing sail to act as a buoyancy device.

Although only a few embodiments of the present invention have been described in detail, it should be apparent to those skilled in the art that the present invention may be embodied in many other specific forms without departing from the spirit or scope of the invention. Particularly, it should be understood that while the invention has been described using a catamaran style sailboat as an example, the described collapsing width structure equally applies to power boats, pontoon boats, and any other multi-hulled boat such as, for example, trimarans. Additionally, it should be apparent that while the telescoping mast has been described primarily as a wing sail mast, the described collapsing mast system can readily be applied to other sails such as conventional flat sails. Further, the telescoping masts of the present invention may be used in a wide variety of applications and are not limited to use with multi-hulled vessels, rather, they may be used in monohulls or other sail driven vehicles. Also, although the variable width boat described included the collapsible masts and wing sails, this is not a requirement of the invention. Other conventional masts and sails may be used to replace the telescoping masts and sails, or alternatively, the masts and sails may be eliminated and the boat may take the form of a power boat.

Therefore, the present examples and embodiments are to be considered as illustrative and not restrictive and the invention is not to be limited to the details given herein, but may be modified within the scope of the appended claims.

What is claimed is:

1. A variable width boat comprising:

(a) a plurality of hulls each having a longitudinal axis;

(b) a collapsible beam operatively connecting the hulls;

(c) a plurality of structural panels pivotally connected to and between the hulls, the structural panels including laterally adjacent deck and roof panels pivotally connected to and between the hulls along axes substantially parallel to the longitudinal axes of the hulls such that the structural panels, in coordination with the collapsible beam, maintaining the hulls in an upright, substantially parallel, longitudinally fixed relationship while permitting the width of the boat to be varied between a closed position and an extended position in which the hulls are laterally spaced apart from one another, the deck and roof panels cooperating to form a usable cabin area and deck area when the boat is in the extended position; and (d) folding means for selectively moving the hulls between the closed position and an extended position and for folding the structural panels in coordination with collapsing the collapsible beam.

2. A variable width boat as set forth in claim 1 further comprising a longitudinally extending central frame pivotally connected to at least some of the deck and roof panels along axes substantially parallel to the longitudinal axes of the hulls, the central frame coordinating the movement of the deck and roof panels throughout the folding and unfolding of the boat.

3. A variable width boat as set forth in claim 2 wherein the central frame is fixed to the midpoints of the collapsible beam, the boat further comprising a plurality of additional frames pivotally connected to at least some of the deck and roof panels along axes substantially parallel to the longitudinal axes of the hulls, these additional frames cooperating with the central frame to coordinate the movement of the deck and roof panels throughout the folding and unfolding of the boat.

4. A variable width boat as set forth in claim 3 further comprising a plurality of folding seating panels pivotally connected to the hulls and the additional frames along axes substantially parallel to the longitudinal axes of the hulls, the seating panels forming seats when the boat is in the extended position and folding in coordination with the deck and roof panels during the folding and unfolding of the boat.

5. A variable width boat as set forth in claim 1 further comprising;

(a) a plurality of windshield panels pivotally connected to the roof panels along the forward edges of the roof panels, and (b) a plurality of door panels pivotally connected to the hulls, the windshield panels and door panels cooperating with the deck and roof panels to allow the cabin area to be enclosed when the boat is in the extended position.

6. A variable width boat as set forth in claim 1 further comprising (a) a plurality of rudders, each rudder being associated with one of the hulls, and (b) steering means for facilitating the steering of the boat, the steering means operatively connecting the rudders and being arranged to permit steering control of the rudders throughout the folding and unfolding of the boat.

7. A variable width boat as set forth in claim 1 wherein the collapsible beam includes a plurality of beam panels, at least some of which are pivotally connected to the hulls such that the beam panels fold in coordination with the structural panels, and a telescoping beam arranged such that the telescoping beam nests into openings in the hulls when the boat is moved into the folded position.

8. A variable width boat as set forth in claim 7 wherein the telescoping beam has an interior cross section large enough to provide usable interior storage or living space when the boat is in the extended position.

9. A variable width boat as set forth in claim 1 wherein the plurality of structural panels include four deck panels and four roof panels, the boat further comprising:

(a) an additional collapsible beam, both of the collapsible beams including a telescoping beam and four beam panels pivotally connected to and between the hulls to fold in coordination with the deck and roof panels;

(b) a longitudinally extending central frame fixed to and between the midpoints of the telescoping beams and pivotally connected to and between at least some of the deck and roof panels along axes substantially parallel to the longitudinal axes of the hulls and pivotally connected to and between at least some of the beam panels along substantially vertical axes; and (c) a longitudinally extending port frame and a longitudinally extending starboard frame pivotally connected to and between at least some of the deck and roof panels along axes substantially parallel to the longitudinal axes of the hulls, the port and starboard frames cooperating with the central frame to coordinate the movement of the deck, roof, and beam panels throughout the folding and unfolding of the boat.

10. A variable width boat as set forth in claim 1 wherein the folding means includes;

(a) a plurality of pulleys mounted to specific locations of a first one of the hulls;

(b) a cable associated with the first hull, the cable being routed through the plurality of pulleys and fixed to a particular point on the collapsible beam; and (c) a first bi-directional winch for moving the cable such that when the cable is moved in one direction the first hull is drawn into the folded position and when the cable is moved in the opposite direction the first hull is moved into the extended position.

11. A variable width boat as set forth in claim 10 wherein the folding means further includes;

(a) a plurality of pulleys mounted to specific locations of a second one of the hulls;

(b) a cable associated with the second hull, the cable being routed through the plurality of pulleys and fixed to a particular point on the collapsible beam; and (c) a second bi-directional winch for moving the cable such that when the cable is moved in one direction the second hull is drawn into the folded position and when the cable is moved in the opposite direction the second hull is moved into the extended position.

12. A variable width boat as set forth in claim 1 wherein the folding means includes;

(a) a plurality of pulleys mounted to specific locations of the collapsible beam;

(b) a cable routed through the plurality of pulleys and fixed to a particular points on the hulls; and (c) a bi-directional winch for moving the cable such that when the cable is moved in one direction the hulls are drawn into the folded position and when the cable is moved in the opposite direction the hulls are moved into the extended position.

13. A mast assembly for use in a sailboat, said mast assembly comprising:

(a) a mast including a plurality of telescoping mast sections each having an upper and a lower end, the mast being arranged to collapse telescopically from an extended position to a collapsed position in which the mast sections nest substantially within a largest cross-sectional mast section which is supported substantially within the sailboat to permit the height of substantially the entire mast to be collapsed to a position substantially within the sailboat; and (b) mast raising means for selectively moving the mast between the extended position and the collapsed position.

14. A mast assembly as set forth in claim 13 wherein the mast is a rotatable mast and the mast assembly further includes a mast steering mechanism for facilitating rotational control of the mast.

15. A mast assembly as set forth in claim 14 wherein the mast steering mechanism includes a sail steering wheel control and a cable system that operatively connects the steering wheel control to the rotatable mast, the steering mechanism being arranged to permit full rotational control of the rotatable mast through a continuous 360 degree rotation of the mast.

16. A mast assembly as set forth in claim 14 further comprising a plurality of mast bearings operatively connected to the mast section which defines the outermost mast section of the mast assembly when the mast assembly is in the lowered position, the mast bearings being adapted to provide means for rotatably attaching the mast to a sailboat.

17. A mast assembly as set forth in claim 13 further comprising;

(a) a plurality of profiled sail supporting ribs each having a peripheral edge, each of the sail supporting ribs being connected to the upper end of an associated mast section, and (b) a covering connected to the peripheral edge of the plurality of sail supporting ribs such that the sail supporting ribs and the covering cooperate to form a wing shaped sail surface when the mast assembly is in the raised position and such that the covering folds accordion style when the mast assembly is moved into the lowered position.

18. A mast assembly as set forth in claim 17 further comprising internal running rigging, the internal running rigging being attached to specific locations on the peripheral edges of the sail supporting ribs and the mast sections to provide structural support to the mast assembly when the mast is in the raised position, and the running rigging being arranged to collapse in coordination with the covering when the mast assembly is moved to the lowered position.

19. A mast assembly as set forth in claim 13 wherein the mast raising means includes;

(a) a plurality of pulleys mounted at the upper and lower ends of each of the mast sections, (b) a cable routed through the pulleys, and (c) a bi-directional winch for raising and lowering the height of the mast assembly, the winch being operatively connected to the cable and the cable being routed through the pulleys such that when the winch moves the cable in a first direction, the mast assembly extends telescopically, and when the winch moves the cable in a second, opposite direction, the mast assembly collapses telescopically.

20. A mast assembly as set forth in claim 13 further comprising a mast head float attached to the upper end of the mast section which defines the uppermost end of the mast assembly when the mast assembly is in the raised position, the mast head float providing sufficient buoyancy to help prevent the boat from fully capsizing 180 degrees.

21. A mast assembly as set forth in claim 13 further comprising a plurality of mast raising latches attached to at least one of the mast sections, the mast raising latches being positioned on each associated mast section such that the mast raising latches disengagably latch the associated mast section in the raised position once the mast raising means has raised the associated mast section into the raised position.

22. A method of launching and trailering a variable width multi-hulled boat to and from a body of water, the boat including a plurality of hulls and a width varying arrangement connected to and between the hulls for selectively moving the hulls between a folded, trailering position and an unfolded, normal operating position in which the hulls are laterally spaced apart from one another, the width varying arrangement including a collapsible beam and a plurality of deck and roof panels pivotally connected to and between the hulls such that the structural panels, in coordination with the collapsible beam, maintain the hulls in an upright, longitudinally fixed, substantially parallel relationship as the hulls are moved laterally between the folded and unfolded positions, the deck and roof panels cooperating to form a usable cabin area and deck area when the boat is in the unfolded position, said method comprising the steps of:

(a) launching the boat into the water from a suitable trailer with the boat in the folded, trailering position;

(b) with the boat in the water, operating the width varying arrangement such that the boat is moved from the folded position to the unfolded, normal operating position with the width varying arrangement maintaining the hulls in an upright, longitudinally fixed, substantially parallel relationship as the hulls are moved laterally from the folded position to the unfolded position, thereby forming the cabin area;

(c) in preparation for trailering the boat, clearing any passengers or provisions from interfering with the operation of the width varying arrangement, (d) with the boat still in the water, operating the width varying arrangement such that the boat is moved from the unfolded, normal operating position to the folded, trailering position with the width varying arrangement maintaining the hulls in an upright, longitudinally fixed, substantially parallel relationship as the hulls are moved laterally from the unfolded position to the folded position; and (e) moving the boat onto the trailer.

23. A method according to claim 22 wherein the boat is a sailboat including a mast assembly for supporting a sail, the mast assembly having a mast made up of a plurality of telescoping mast sections each having an upper and a lower end, the mast sections being arranged to collapse telescopically to permit the height of the mast to be extended and collapsed, and said mast assembly having mast raising means for selectively moving the mast between a raised, extended position and a lowered, collapsed position, said method further comprising the steps of:

a) after launching the boat, moving the mast assembly from the lowered position into the raised position by operating the mast raising means in a first mast raising manner, and b) in preparation for trailering, moving the mast from the raised position to the lowered position by operating the mast raising means in a second mast lowering manner.

24. A method of raising and lowering a mast assembly for supporting a sail for a sailboat, the mast assembly including a mast made up of a plurality of telescoping mast sections, the mast being arranged to collapse telescopically from a raised position to a lowered position in which the mast sections nest substantially within a largest cross-sectional mast section which is supported substantially within the sailboat to permit the height of substantially the entire mast to be collapsed to a position substantially within the sailboat, and said mast assembly having mast raising means for selectively moving the mast between the raised position and the lowered position, said method comprising the steps of:

a) moving the mast assembly from the lowered position into the raised position by operating the mast raising means in a first mast raising manner, thereby raising the mast such that the mast is able to support the sail, and b) moving the mast from the raised position to the lowered position substantially within the sailboat by operating the mast raising means in a second mast lowering manner.

* * * * *